US012281830B2

(12) United States Patent
McClendon

(10) Patent No.: US 12,281,830 B2
(45) Date of Patent: Apr. 22, 2025

(54) REFRIGERATION HEAT RECLAIM

(71) Applicant: Walmart Apollo, LLC, Bentonville, AR (US)

(72) Inventor: James Patrick McClendon, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 18/666,150

(22) Filed: May 16, 2024

(65) Prior Publication Data

US 2024/0302089 A1 Sep. 12, 2024

Related U.S. Application Data

(60) Division of application No. 17/007,304, filed on Aug. 31, 2020, now Pat. No. 12,025,357, which is a (Continued)

(51) Int. Cl.
*F25B 49/02* (2006.01)
*F25B 6/02* (2006.01)
*F25B 45/00* (2006.01)

(52) U.S. Cl.
CPC ..... *F25B 49/027* (2013.01); *F25B 6/02* (2013.01); *F25B 45/00* (2013.01); (Continued)

(58) Field of Classification Search
CPC ..... F25B 49/027; F25B 6/02; F25B 45/00; F25B 2700/133; F25B 2700/19; F25B 2700/21
See application file for complete search history.

(56) References Cited

U.S. PATENT DOCUMENTS 4,193,781 A 3/1980 Vogel et al.
5,181,552 A 1/1993 Eiermann
(Continued)

FOREIGN PATENT DOCUMENTS

WO 2013084510 A1 6/2013

OTHER PUBLICATIONS

Reddy, Teja "Analog and Digital Signals," Dec. 29, 2012.
(Continued)

*Primary Examiner* — Nelson J Nieves
*Assistant Examiner* — Matthew John Moscola
(74) *Attorney, Agent, or Firm* — Foley IP Law, PLLC

(57) ABSTRACT

Provided are a refrigeration heat reclaim unit and method, comprising a heat exchanger, comprising a refrigerant inlet that receives a flow of refrigerant having a first state; a refrigerant outlet that outputs the flow of refrigerant having a second state; a water loop inlet that receives a flow of liquid at a first temperature; a water loop outlet that outputs the flow of liquid from the reclaim heat exchanger at a second temperature that is greater than the first temperature in response to the flow of refrigerant. The refrigeration reclaim unit also comprises a refrigerant flow control device having outputs to the refrigerant inlet and an air-cooled condenser, respectively for controlling the flow of refrigerant to at least one of the refrigerant inlet and the air-cooled condenser for maintaining a predetermined flow quality value at the refrigerant outlet.

13 Claims, 7 Drawing Sheets

Related U.S. Application Data continuation of application No. 15/044,772, filed on Feb. 16, 2016, now Pat. No. 10,788,248.

(60) Provisional application No. 62/120,020, filed on Feb. 24, 2015.

(52) U.S. Cl.
CPC ..... *F25B 2700/133* (2013.01); *F25B 2700/19* (2013.01); *F25B 2700/21* (2013.01)

(56) References Cited

U.S. PATENT DOCUMENTS

| | | | |
|---|---|---|---|
| 5,654,885 | A | 8/1997 | Mayhew et al. |
| 5,673,567 | A | 10/1997 | Dube |
| 5,685,161 | A | 11/1997 | Peckjian et al. |
| 5,826,433 | A | 10/1998 | Dube |
| 5,987,907 | A | 11/1999 | Morimoto et al. |
| 6,216,481 | B1 | 4/2001 | Kantchev |
| 7,237,394 | B2 | 7/2007 | Rigal et al. |
| 8,046,107 | B2 | 10/2011 | Zugibe et al. |
| 2006/0144059 | A1 | 7/2006 | Kang et al. |
| 2009/0120110 | A1 | 5/2009 | Grabon et al. |
| 2011/0005243 | A1 | 1/2011 | MacRi |
| 2011/0041505 | A1 | 2/2011 | Kasuya et al. |
| 2012/0285186 | A1 | 11/2012 | Honda |
| 2013/0227976 | A1 | 9/2013 | Yamashita |
| 2013/0240172 | A1 | 9/2013 | Reilly et al. |
| 2013/0340455 | A1 | 12/2013 | Martin et al. |
| 2014/0260385 | A1 | 9/2014 | Umeda et al. |
| 2016/0178262 | A1 | 6/2016 | Rocha et al. |

OTHER PUBLICATIONS

Intemational Preliminary Report on Patentability in International Patent Application No. PCT/US16/18064, mailed on Sep. 8, 2017; 12 pages.

Intemational Search Report & Written Opinion in counterpart International Patent Application No. PCT/US16/18064, mailed on Apr. 11, 2016; 13 pages.

3-Way Valves: Installation and Servicing Instructions, Bulletin 30-21, Jun. 2001, Sporlan Valve Company; 12 pages.

Horning, Harrison, "Advanced Heat Reclaim Systems", Energy & Store Development Conference, Food Marketing Institute, Sep. 19-22, 2010, Minneapolis, MN; 23 pages.

Hotspot Heat Recovery Water Heater Frequently Asked Questions, Hotspotenergy.com, Hotspot Energy LLC, 2010, accessed on Jan. 13, 2015; 2 pages.

300

REFRIGERATION HEAT RECLAIM

RELATED APPLICATIONS

This application is a divisional application of U.S. patent application Ser. No. 17/007,304, filed Aug. 31, 2020, entitled "REFRIGERATION HEAT RECLAIM", which is a continuation application of U.S. patent application Ser. No. 15/044,772, filed on Feb. 16, 2016, entitled "REFRIGERATION HEAT RECLAIM", which claims priority to U.S. Provisional Application Ser. No. 62/120,020, filed on Feb. 24, 2015, entitled "REFRIGERATION HEAT RECLAIM", the entirety of each of which is incorporated by reference herein.

FIELD

The present concepts relate generally to the field of refrigeration, and more specifically, to refrigeration heat reclaim systems and methods.

BACKGROUND

Refrigeration systems require a significant amount of energy to operate. Heat generated by refrigeration systems is typically dissipated as waste heat to the environment.

BRIEF SUMMARY

In one aspect, provided is a refrigeration heat reclaim unit, comprising: a heat exchanger, comprising: a refrigerant inlet that receives a flow of refrigerant having a first state; a refrigerant outlet that outputs the flow of refrigerant having a second state; a water loop inlet that receives a flow of liquid at a first temperature; a water loop outlet that outputs the flow of liquid from the reclaim heat exchanger at a second temperature that is greater than the first temperature in response to the flow of refrigerant. The refrigeration reclaim unit also comprises a refrigerant flow control device having outputs to the refrigerant inlet and an air-cooled condenser, respectively for controlling the flow of refrigerant to at least one of the refrigerant inlet and the air-cooled condenser for maintaining a predetermined flow quality value at the refrigerant outlet.

In some embodiments, the refrigerant flow control device includes a three-way mass flow diverting valve.

In some embodiments, the three-way mass flow diverting valve is a modulating, linear valve that performs analog modulation.

In some embodiments, the refrigerant flow control device comprises: an input port for receiving the flow of refrigerant from a refrigerant compressor; a first output port that outputs a first proportion of the flow of refrigerant to the heat exchanger; and a second output port that outputs a second proportion of the flow of refrigerant to the air cooled condenser.

In some embodiments, the refrigerant flow control device achieves or supports a mass flow balance.

In some embodiments, the refrigerant flow control device monitors refrigerant pressure and temperature at the refrigerant inlet and the refrigerant outlet for controlling the flow of refrigerant.

In some embodiments, the first state is a saturated vapor and the second state is a saturated liquid.

In some embodiments, the system further comprises a bypass device between the input port and the second output port in response to a high refrigerant temperature or a high refrigerant pressure.

In some embodiments, the refrigerant flow control device controls the flow of refrigerant simultaneously to the refrigerant inlet and the air-cooled condenser for maintaining a predetermined flow quality value at the refrigerant outlet.

In another aspect, provided is a refrigerant mass flow system, comprising a refrigerant flow control device comprising an input port for receiving a flow of refrigerant from a refrigerant compressor; a first output port that outputs a first proportion of the flow of refrigerant to a heat exchanger; and a second output port that outputs a second proportion of the flow of refrigerant to an air cooled condenser, and a controller for controlling the first and second proportions of refrigerant for maintaining a predetermined flow quality value at an outlet of the heat exchanger.

In some embodiments, the first proportion of the flow of refrigerant may be output to the heat exchanger as a saturated vapor, and the flow of refrigerant at the outlet of the heat exchanger is a saturated liquid.

the first proportion of the flow of refrigerant is output to the heat exchanger as a saturated vapor, and the flow of refrigerant at the outlet of the heat exchanger is a saturated liquid.

In some embodiments, the refrigerant mass flow system may further comprise a bypass device between the input port and the second output port in response to a high refrigerant temperature or high refrigerant pressure.

In some embodiments, the refrigerant flow control device may control the flow of refrigerant simultaneously to the heat exchanger inlet and the air-cooled condenser for maintaining a predetermined flow quality value at the heat exchanger outlet.

In another aspect, provided is method for controlling a flow of refrigerant at a refrigeration system, comprising: measuring a temperature and pressure of a flow of refrigerant at a refrigerant outlet of a heat exchanger; comparing the measured refrigerant temperature and pressure to a reference pressure-temperature setpoint; and modulating a refrigerant flow control device in response to the comparison.

In some embodiments, modulating the refrigerant flow control device may comprise controlling the flow of refrigerant to at least one of a refrigerant inlet of the heat exchanger and an air-cooled condenser for maintaining a predetermined flow quality value at the refrigerant outlet.

In some embodiments, the refrigerant flow control device may control the flow of refrigerant simultaneously to the refrigerant inlet and the air-cooled condenser for maintaining a predetermined flow quality value at the refrigerant outlet.

In some embodiments, modulating the refrigerant flow control device may comprise receiving at the refrigerant flow control device the flow of refrigerant from a refrigerant compressor; outputting from a first output port a first proportion of the flow of refrigerant to the heat exchanger; and outputting from a second output port a second proportion of the flow of refrigerant to an air cooled condenser.

In some embodiments, the method may further comprise monitoring refrigerant pressure and temperature at each of the refrigerant inlet and the refrigerant outlet for controlling the flow of refrigerant.

In some embodiments, the method may further comprise receiving at a refrigerant inlet of the heat exchanger a flow of refrigerant having a first state; and outputting at a refrigerant outlet of the heat exchanger the flow of refrigerant having a second state.

In some embodiments, the first state is a saturated vapor and the second state is a saturated liquid.

In some embodiments, the method may further comprise coupling a bypass device between the refrigerant inlet and the refrigerant outlet that outputs a proportion of refrigerant to an air-cooled condenser in response to high refrigerant temperature or high refrigerant pressure.

BRIEF DESCRIPTION OF THE SEVERAL VIEWS OF THE DRAWINGS

The above and further advantages may be better understood by referring to the following description in conjunction with the accompanying drawings, in which like numerals indicate like structural elements and features in various figures. The drawings are not necessarily to scale, emphasis instead being placed upon illustrating the principles of the FIG. 1 is a perspective view of a refrigeration heat reclaim unit, in accordance with some embodiments;

DETAILED DESCRIPTION

Refrigeration heat reclaim is a feature of some refrigeration systems, whereby heat generated during a refrigeration operation which would otherwise be wasted at a condenser can be recovered and diverted for another useful purpose, such as a source of heat for another fluid stream (i.e., a gaseous or liquid substance) having a lower temperature requirement. In doing so, the amount of energy purchased for use by the refrigeration system can be reduced in favor of reclaimed energy that would otherwise be exhausted to the environment.

Figure 1:
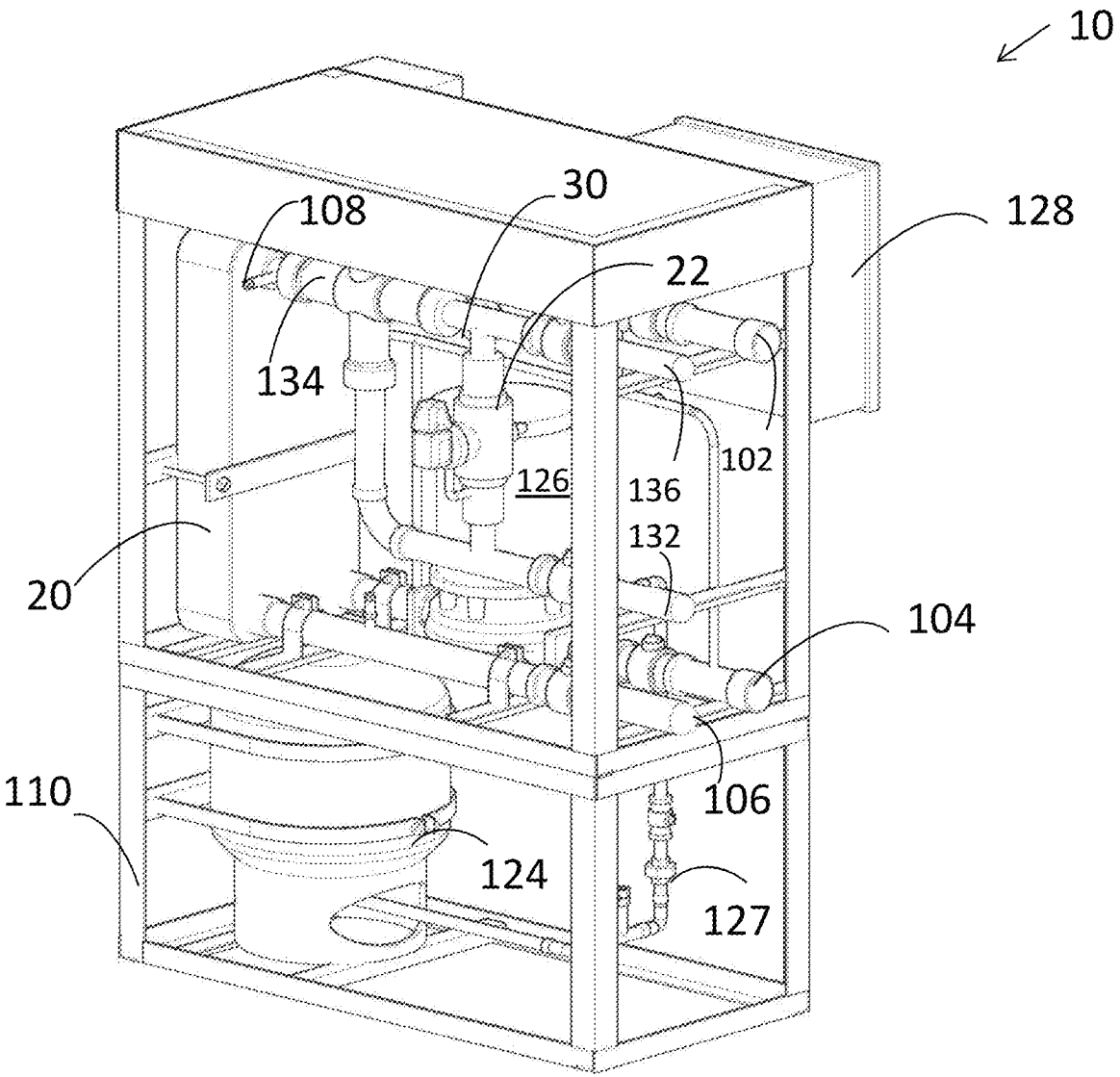
Figure 2A:
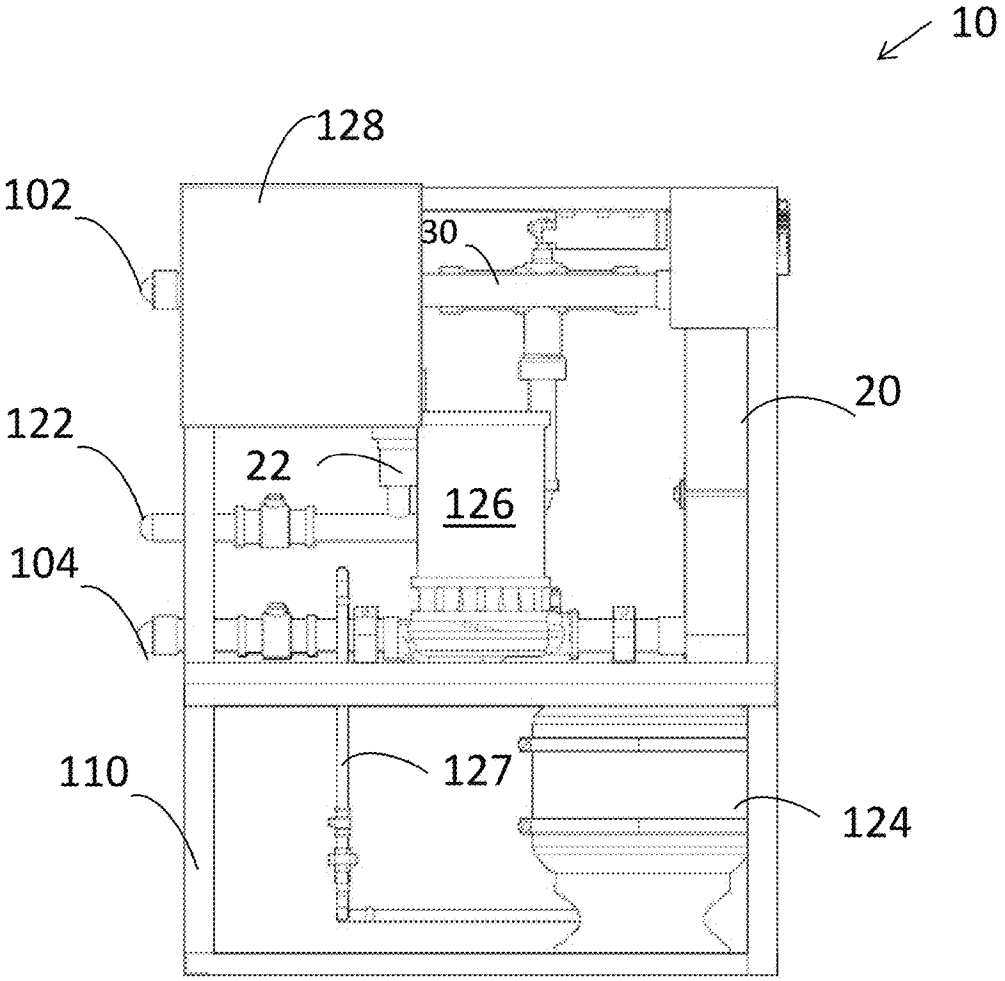
FIG. 2A is a front view of the refrigeration heat reclaim unit of FIG. 1, in accordance with some embodiments.
Figure 2B:
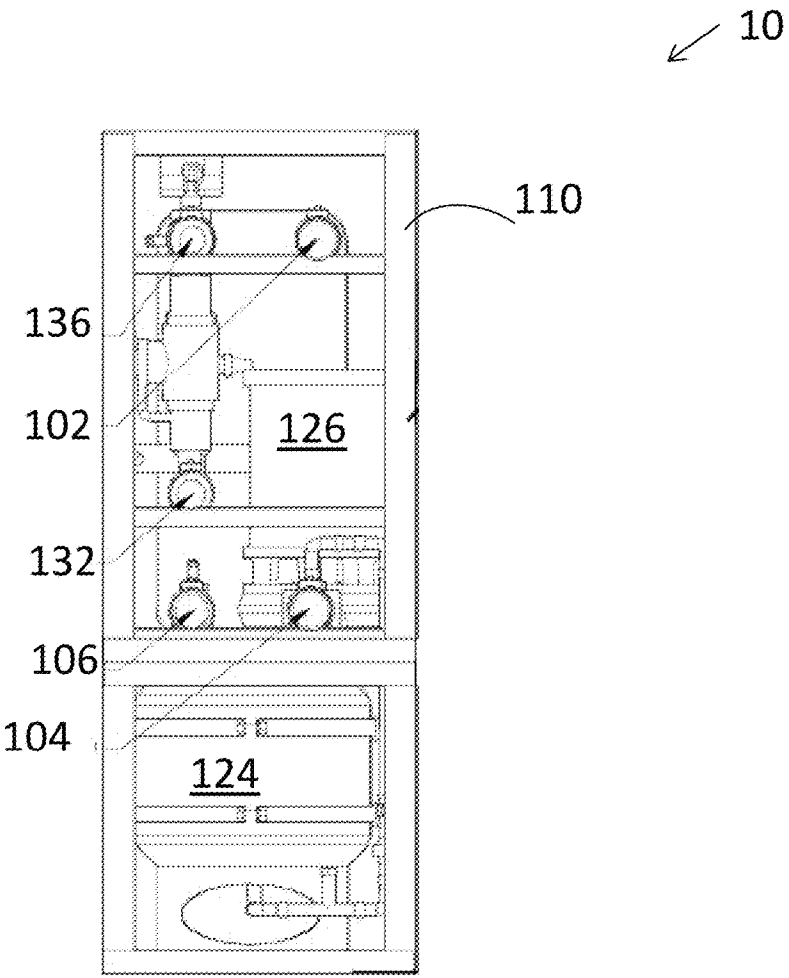
FIG. 2B is a side view of the refrigeration heat reclaim unit of FIGS. 1 and 2A, in accordance with some embodiments.
Figure 2C:
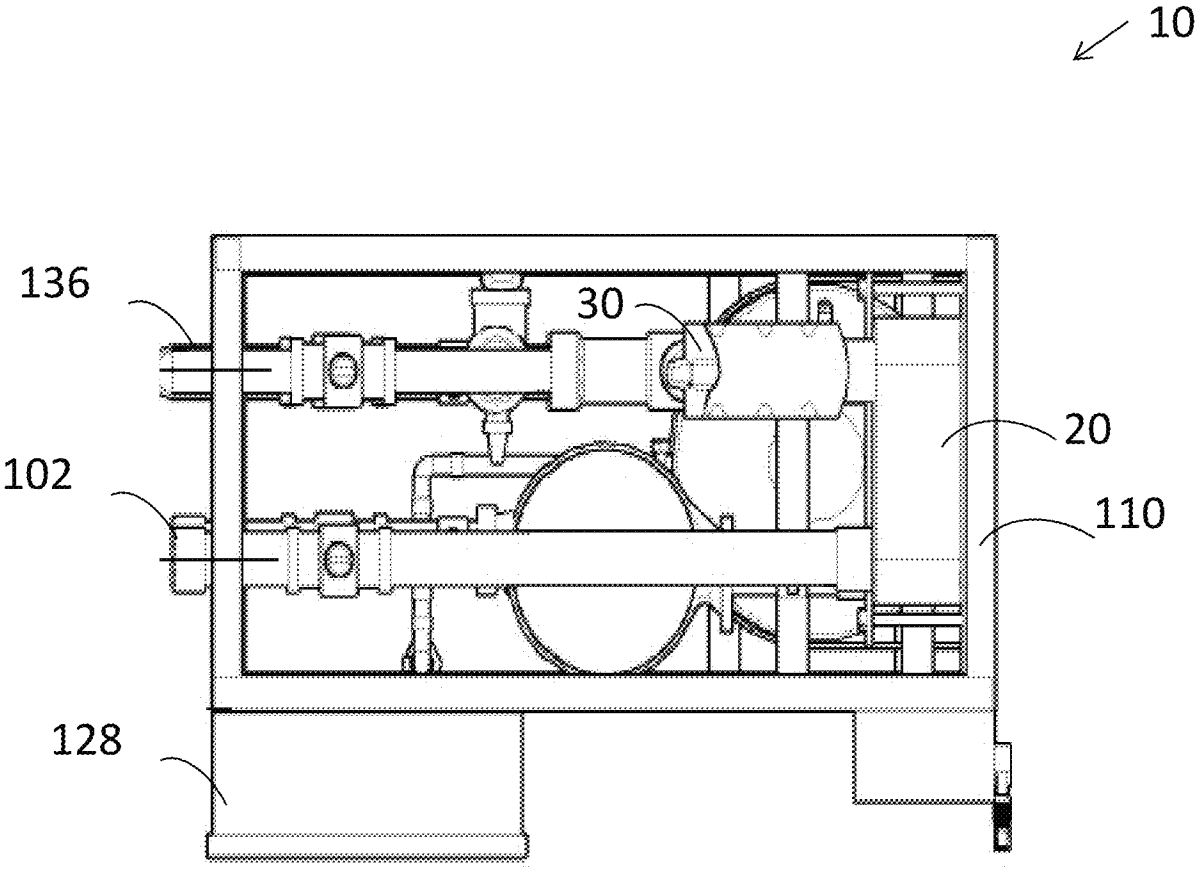
FIG. 2C is a top view of the refrigeration heat reclaim unit of FIGS. 1, 2A, and 2B in accordance with some embodiments.

FIG. 1 is a perspective view of a refrigeration heat reclaim unit 10, in accordance with some embodiments. FIG. 2A is a front view of the refrigeration heat reclaim unit 10 of FIG. 1, in accordance with some embodiments. FIG. 2B is a side view of the refrigeration heat reclaim unit 10 of FIGS. 1 and 2A, in accordance with some embodiments. FIG. 2C is a top view of the refrigeration heat reclaim unit 10 of FIGS. 1, 2A, and 2B in accordance with some embodiments.

Figure 3:
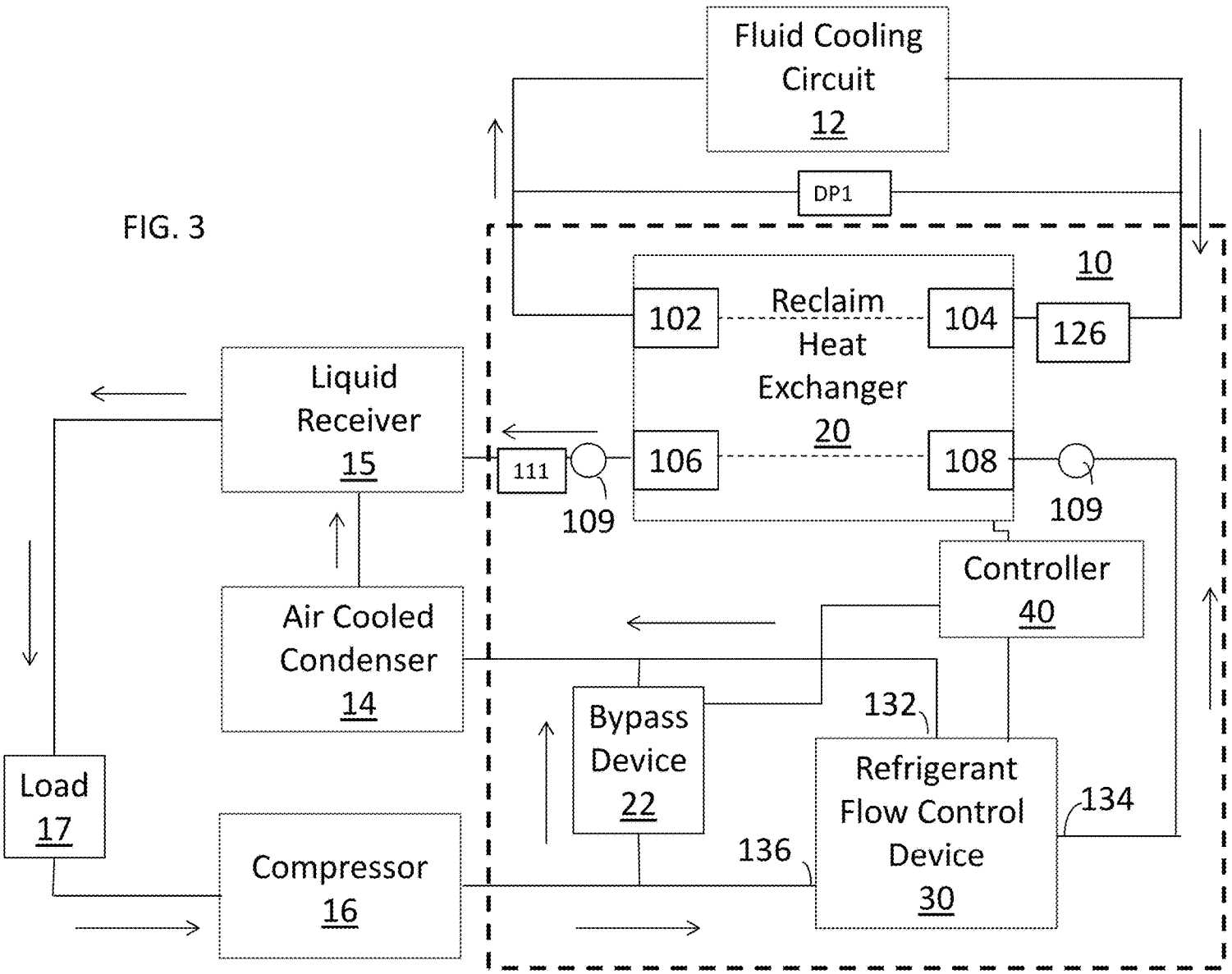
FIG. 3 is a schematic diagram of a refrigeration cycle, in accordance with some embodiments.

The refrigeration heat reclaim unit 10 includes a reclaim heat exchanger 20 and a refrigerant flow control device 30 positioned in a housing 110, along with an expansion tank 124 and a pump 126 for circulating heat exchanger fluid, an electrical panel 128, and a set of inlets and outlets for coupling with various other elements of a refrigeration system, for example, illustrated at FIG. 3. Various pumps, switches, valves, sensors, and the like (not shown) can also be positioned at the housing 110 for providing parallel mass flow in accordance with some embodiments.

Coupled to the heat exchanger 20 in the housing 110 of the refrigeration heat reclaim unit 10 includes a water loop supply outlet 102, a water loop supply inlet 104, and a liquid refrigerant outlet 106. Also coupled to the heat exchanger 20 is an outlet 134 of the flow control device 30, which controls the flow of refrigerant according to temperature and pressure at the heat exchanger inlet 108. The water loop supply inlet 104 receives water or other cooling fluid or gas for reducing a temperature of superheated refrigerant in the heat exchanger 20 received via the flow control device 30. The water loop supply output 102 outputs the circulating fluid liquid or gas heated by the heat from the refrigerant flowing through the heat exchanger 20. The liquid refrigerant outlet 106 outputs the refrigerant cooled by the circulating fluid. The refrigerant can therefore transition at the reclaim heat exchanger 20 from a superheated vapor, for example, output from a compressor 16 (see FIG. 3), to a liquid due to removal of heat from the refrigerant by the circulating cooling fluid.

The expansion tank 124 may absorb excess water pressure caused by thermal expansion with respect to the water or other fluid received at the water loop supply inlet 104, which is heated during heat transfer from the refrigerant at the reclaim heat exchanger 20. A fluid path 127 extends between the expansion tank 124 and the water loop supply inlet 104.

A fluid pump 126 can be provided along the water loop supply inlet 104 for providing a supply of water or other cooling fluid to a heating load.

The electrical panel 128 provides power via a power source, i.e., battery, electrical outlet, and so on to the various elements of the unit 100 via electrical connectors (not shown). The electrical panel 128 can also include some or all interconnections between a refrigerant flow controller 40 (see FIG. 3) and various sensors 109, pumps, valves, and/or the reclaim heat exchanger 20 and the flow control device 30 that exchange signals with the controller 40 and/or each other for controlling a mass flow in accordance with some embodiments.

A bypass device 22 can extend between an inlet 136 of the refrigerant flow control device 30 and an outlet 136 of the refrigerant flow control device 30 that outputs a proportion of refrigerant to an air-cooled condenser. The bypass device 22 can include a 2-way solenoid valve or the like that functions as a safety bypass to bypass the heat reclaim elements. For example, the bypass device 22 can be activated in response to high refrigerant temperature or high refrigerant pressure. The bypass device 22 can also act in response to high fluid temperature on the loop 12 or when the fluid pump 126 experiences a loss of flow or mechanical/electrical failure.

FIG. 3 is a schematic diagram of a refrigeration cycle, in accordance with some embodiments. In describing the refrigeration cycle, reference is made to elements of the reclaim heat exchanger 20 of FIGS. 1 and 2A-2C, which is part of a closed refrigeration system for recapturing waste heat. Other elements of the refrigeration system can include, but not be limited to a fluid cooling circuit 12, air-cooled condenser 14, a liquid receiver 15, and a compressor 16. Other elements may be part of the refrigeration cycle but not shown, such as an evaporator, as well as various pumps, switches, valves, sensors, and the like for controlling the flow, temperature, pressure, and/or state of refrigerant and/or cooling fluids, respectively. For example, in some parts of the cycle, the refrigerant is a liquid, and in other parts of the cycle, the refrigerant is a gas or vapor.

The refrigeration cycle includes both a cooling fluid loop and a refrigerant loop for providing a parallel mass flow between the air-cooled condenser 14 and the reclaim heat exchanger 20 which in some embodiments is part of the heat reclaim unit 10. The reclaim heat exchanger 20 receives a flow of fluid from the fluid cooling circuit 12, for example, including a cooling tower, fluid to air heat exchanger or the like, for cooling a flow of refrigerant received by the heat exchanger 20. More specifically, water or other fluid liquid or gas circulates through the heat exchanger 20 via the water loop inlet 104, which receives a flow of fluid from the fluid cooling circuit 12 for cooling a flow of refrigerant at a first state, e.g., a vapor, received at a refrigerant inlet. Accordingly, heat is removed from the refrigerant flow and is exchanged or transferred to the circulating fluid liquid or gas of the fluid cooling circuit 12. In doing so, the temperature and pressure of the refrigerant flow through the heat exchanger 120 is reduced. The cooled flow of refrigerant is output from the refrigerant outlet 106 to the liquid receiver 15 in a second state, e.g., a liquid. The flow of fluid circulating through the fluid cooling circuit 12 can be controlled in any desired manner known to those of ordinary skill in the art, for example, through the use of valves or the like.

In some embodiments, the refrigerant flow control device 30 includes a modulating, linear, three-way refrigerant mass flow diverting valve for controlling a flow of refrigerant received from the compressor 16. The refrigerant flow control device 30 includes an inlet 136 in communication with a compressor 16, a first outlet 134 in communication with a refrigerant inlet 108 of the reclaim heat exchanger 20, and a second outlet 132 in communication with an air-cooled condenser. A refrigerant flow controller device 40 is used for monitoring refrigerant pressure and temperature at the refrigerant inlet 108 and outlet 106, and determining or calculating the mass flow ratio, or ratio of high-temperature mass flow rate at inlet 108 to low-temperature circuit mass flow rate at outlet 106. Refrigerant flow controller 40 provides control action, by means of electronic or communication signal or instruction, to refrigerant mass flow diverting control valve 30 such to maintain a predetermined refrigerant mass flow quality value at the refrigerant outlet 106.

The compressor 16 receives the refrigerant from a load 17, for example, a device or system that controls the flow of gaseous refrigerant into the compressor 16. Here, the liquid refrigerant experiences pressure and/or temperature changes, for example, a drop in pressure and rise in temperature such that the liquid refrigerant vaporizes into a superheated gas prior to entering the compressor 16, which compresses the refrigerant to a high temperature, high pressure compressed refrigerant vapor or gas provided to the refrigeration heat reclaim system 10 in a controlled manner by the flow control device 30.

At the reclaim heat exchanger 20, heat of the superheated refrigerant vapor is removed from the refrigerant and transferred to the circulating fluid, e.g., water, from the fluid cooling circuit 12 having a lower temperature than the refrigerant flowing through the reclaim heat exchanger 20. Accordingly, the flow of refrigerant cooled by the circulating fluid is condensed and output from the reclaim heat exchanger 20 to the liquid receiver 15 in a liquid state.

The refrigerant flow control device 30 is positioned along a refrigerant flow path between the compressor 16 and the reclaim heat exchanger 20 for controlling a flow of the refrigerant to the reclaim heat exchanger 20, more specifically, dividing and controlling superheated refrigerant mass flows between, and with respect to, the air-cooled condenser 14 and/or the reclaim heat exchanger 20 to maintain a specific refrigerant saturated condensing pressure and temperature as to control a refrigerant quality ('x') value of x=0.0 at the heat exchanger outlet 106, whereas the quality is represented as the refrigerant state coincident with the saturated liquid line associated with the specific refrigerant 'pressure-enthalpy' chart, therefore providing maximum heat exchanger effectiveness while ensuring a solid liquid state exists to merge with the liquid output of the air-cooled condenser 14. A quality value of x=0, or a refrigerant state coincident with the saturated liquid line on the pressure-enthalpy chart, represents the maximum latent heat transfer potential of the chemical compound.

The refrigerant flow control device 30 receives superheated refrigerant mass flow from the compressor 16 and includes a first outlet 134 for outputting a first proportion of superheated refrigerant gas mass flow to the reclaim heat exchanger 20, and a second outlet 132 for outputting a second proportion of superheated refrigerant gas mass flow to the air-cooled condenser 14. Reclaim heat exchanger 20 and/or air-cooled condenser 14 provides for condensing the superheated refrigerant prior to outputting to the liquid receiver 15. The first proportion of superheated refrigerant mass flow outputting from refrigerant flow control device 30 can enter the reclaim heat exchanger 20 simultaneously with the second proportion of superheated refrigerant mass flow to the air-cooled condenser 14. The refrigerant flow control device 30 can control the flow of refrigerant simultaneously to the refrigerant inlet 108 and the air-cooled condenser 14 for maintaining a predetermined flow quality value at the refrigerant outlet 106.

The controller 40 can monitor refrigerant pressure and temperature along the refrigerant flow path and instruct or direct refrigerant flow control device 30, more specifically, using flow meters, sensors, or the like, at the refrigerant inlet 108 and outlet 106 of the reclaim heat exchanger 20 along the refrigerant flow path. The controller 40 controls the first and second proportions output from the refrigerant flow control device 30, and determining a mass flow ratio, to maintain a predetermined flow quality value at the refrigerant outlet. For example, the controller 40 can instruct the flow control device 30 to allow a required refrigerant mass flow needed to satisfy a current heating demand to pass into the reclaim heat exchanger 20, while directing all remaining mass flow to the existing air cooled condenser. The two heat exchanger outlet liquid streams, condenser and heat reclaim, are returned to the liquid receiver separately. In some embodiments, as shown in FIG. 1, the controller 40 is co-located with the reclaim heat exchanger 20 and/or the flow control device 30. In other embodiments, the controller 40 is external to the refrigeration heat reclaim system 10, and remotely controls the mass flow ratio corresponding to refrigerant quality at the flow control device 30. The controller 40 can include a hardware processor and memory having contents that are executed by the hardware processor to perform the functions of the controller 40.

The refrigerant flow control device 30 provides for reclamation of waste heat without requiring physical elevation of the reclaim heat exchanger 20 above the air-cooled condenser 14 required with conventional heat reclaim approaches. In conventional series flow configurations, a heat exchanger output must be above a condenser inlet in order for gravity to cause fluid flow to occur. In the refrigeration system according to embodiments, the reclaim heat exchanger 20 can include a refrigerant outlet 106 that is above the liquid receiver 15, which is typically arranged to be below the condenser 14. The refrigeration heat reclaim unit can be oriented in a horizontal or vertical configuration, or other position obviating specific elevation requirements. The refrigeration heat reclaim unit can be pre-engineered, pre-fabricated, and packaged with fixed capacities, allowing for an expedient and inexpensive deployment as compared to conventional systems. The packaged unit permits economics of scale to be applied to a specific refrigeration system design, allowing for cost reductions in fabrication and installation as well as energy cost savings.

Also, the parallel mass flow arrangement in accordance with some embodiments does not require a significant additional refrigerant charge. Therefore, liquid refrigerant management in ambient extremes is not affected beyond existing system requirements. Only the required refrigerant mass flow needed to satisfy a current heating demand is allowed to pass into the reclaim heat exchanger 20. All remaining mass flow is directed to the air cooled condenser 14. The two heat exchanger outlet liquid streams, namely, the condenser and heat reclaim, are preferably returned to the liquid receiver 15 separately. The parallel mass flow arrangement operates completely transparent to the existing refrigeration system, and requires less total refrigerant charge than a conventional series flow arrangement.

Figure 4:
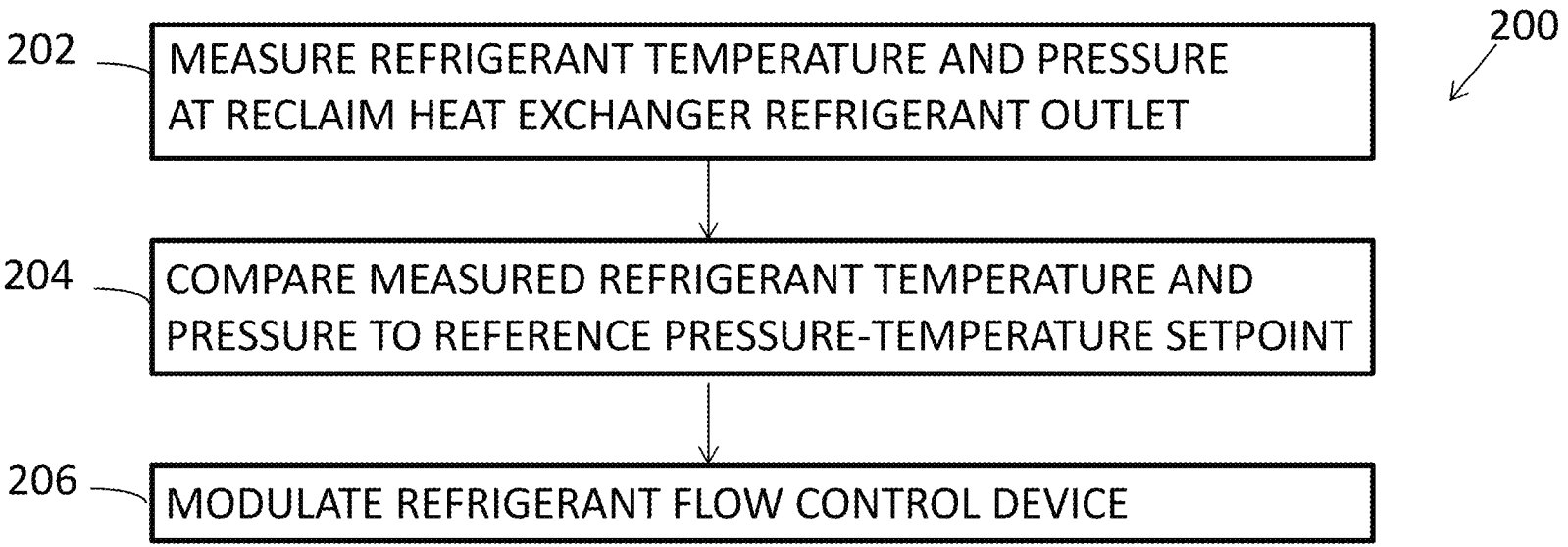
FIG. 4 is a flow diagram illustrating a method for controlling a flow of refrigerant between a reclaim heat exchanger and a condenser, in accordance with some embodiments.

FIG. 4 is a flow diagram illustrating a method 200 for controlling a flow of refrigerant between a reclaim heat exchanger and a condenser, in accordance with some embodiments. In describing the method 200, reference is made to elements of the refrigeration cycle illustrated at FIGS. 1-3.

Another feature of a parallel mass flow arrangement in accordance with some embodiments is the presence of the controller 40, which can provide an integral heat balance between the air-cooled condenser 14 and the reclaim heat exchanger 20. Accordingly, in some embodiments, some or all of the method 200 is implemented and executed by the controller 40.

At block 202, a temperature of the fluid refrigerant at the outlet 106 of the heat exchanger 20 is measured by a sensor 109 or the like. Similarly, a refrigerant pressure can also be measured by a sensor 109 or the like at the outlet 106 of the heat exchanger 20. One or more temperature and/or pressure sensors or the like can be positioned between the outlet 106 and the liquid receiver 15. Other sensors may be positioned at other relevant locations, for example, between the refrigerant outlet 134 and the reclaim heat exchanger inlet 108, for measuring fluid temperature and/or pressure at the inlet 108. A check valve 111 can also be at the outlet 106 that performs or otherwise establishes a pressure balance between reclaim heat exchanger outlet 106 and air-cooled condenser outlet such that both paths of refrigerant mass flow heat exchange maintain an equal or common pressure at liquid receiver 15.

At block 204, the measured temperature and pressure at the heat exchanger outlet 106 are compared to a reference pressure-temperature (PT) setpoint for a target condition at the refrigerant outlet 106 that corresponds to a refrigerant quality (x) value of zero (x=0). The setpoint values are specific to the type of refrigerant which is used and is well-known to one or ordinary skill in the art, for example, Forane® 407A refrigerant, and for a target saturated condensing temperature (SCT), for example, shown in FIG. 5. The controlling of the quality position, i.e., x=0, allows maximum heat exchanger effectiveness while ensuring that a liquid state exists at the outlet 106 to merge with the liquid refrigerant output from the air-cooled condenser 14 to the liquid receiver 15.

At block 206, the refrigerant flow control device 30 is modulated by the controller 40 in response to the comparison between the measured temperature and pressure at the heat exchanger outlet 106 and the reference PT setpoint. For example, the controller 40 modulates or linearly opens or closes the refrigerant flow control device 30 such that the measured temperature and pressure conditions correspond with the target saturated condensing temperature and pressure conditions.

Figure 5:
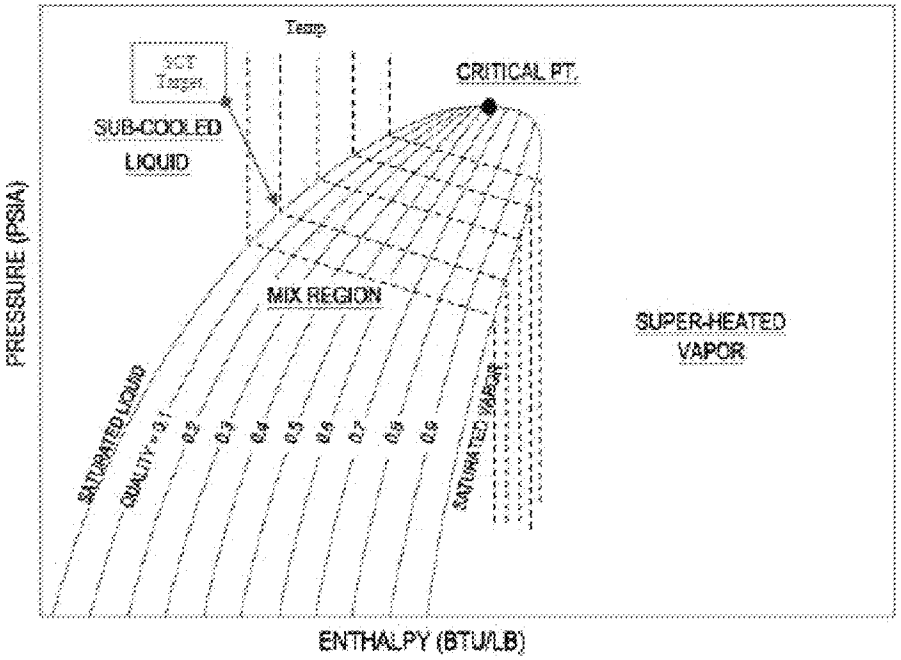
FIG. 5 is a pressure-enthalpy (p-h) diagram for a refrigeration cycle, in accordance with some embodiments.

For example, as shown in FIG. 5, an increase in a measured pressure and/or temperature above the SCT target at the outlet 106 may occur. Here, the controller 40 can modulate the flow control device 30, for example, modulate toward a close position, until the measured pressure decreases to equal the reference pressure for the reference SCT value, for example, 70 degrees F. shown in FIG. 5. Similarly, a decrease in a measured pressure and/or temperature below the SCT target at the outlet 106 may occur. Here, the controller 40 can modulate the flow control device 30, for example, open position, until the measured temperature increases to equal the reference temperature for the reference SCT value.

In some embodiments, the controller 40 can perform other functions, some or all of which can be part of a control sequence. For example, the controller 40 can activate or inactivate a pump at the heat exchanger 20 with respect to a fluid flow through the heat exchanger 20 if an outside temperature falls above or below an active control setpoint temperature indicating or creating a heat demand situation whereby the reclaim heat exchanger 20 may provide all or a portion of the heat to offset or satisfy the heat demand. For example, outside temperatures below a setpoint may indicate that heat is needed to satisfy an outside air ventilation demand in an occupied building, for example, the outside air heating load provides a heat rejection cooling capacity for reclaim heat exchanger 20, for example, refrigerant mass flow control device 30, may direct a proportion of the refrigerant mass flow to reclaim heat exchanger inlet 108, for example, superheated refrigerant mass flow at inlet 108 may exchange or transfer heat to reclaim fluid flow at outlet 102 to offset or satisfy outside air ventilation heating demand.

The controller can, under certain conditions, energize the bypass device 22 to bypass refrigerant mass flow from the refrigerant flow control device 30 directly to the air cooled condenser 14 without going thru the refrigerant flow control device 30. For example, when the controller 40 detects a loss of flow via a fluid flow differential pressure switch, the controller 40 can open the bypass device 22 allowing normal refrigerant flow to the air cooled condenser 14. If a determination is made the measured pressure is greater than a predetermined refrigerant high pressure limit, or the measured fluid temperature is greater than a predetermined high temperature limit, for example, 90° F., the controller 40 can open the refrigerant bypass device 22. Similarly, upon an unacceptable drop in pressure and/or temperature, the controller can close the bypass device 22.

As will be appreciated by one skilled in the art, concepts may be embodied as a device, system, method, or computer program product. Accordingly, aspects may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects may take the form of a computer program product embodied in one or more computer readable medium(s) having computer readable program code embodied thereon.

Computer program code for carrying out operations for the concepts may be written in any combination of one or more programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Concepts are described herein with reference to flowchart illustrations and/or block diagrams of methods, apparatus (systems) and computer program products according to embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, cloud-based infrastructure architecture, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While concepts have been shown and described with reference to specific preferred embodiments, it should be understood by those skilled in the art that various changes in form and detail may be made therein without departing from the spirit and scope as defined by the following claims.

What is claimed is:

1. A system for controlling a flow of refrigerant at a refrigeration system, comprising:

a condenser for exchanging heat;

a heat reclaim unit that recovers at least a portion of heat exchanged at the condenser;

a first sensor that measures a temperature and pressure of a first flow of refrigerant at an inlet of the heat reclaim unit;

a second sensor that measures a temperature and pressure of a second flow of refrigerant at an outlet of the heat reclaim unit;

a controller that compares the measured temperature and pressure at the outlet to a reference pressure-temperature setpoint; and a refrigerant flow control device coupled to both the condenser and the heat reclaim unit, and modulated by the controller for outputting proportions of the refrigerant to the condenser and the heat reclaim unit, respectively, until the measured pressure changes to equal a reference pressure of the pressure-temperature setpoint or until the measured temperature changes to equal a reference temperature of the pressure-temperature setpoint.

2. The system of claim 1, wherein the refrigerant flow control device is modulated by the controller controlling the flow of refrigerant to at least one of the inlet of the heat reclaim unit and the condenser for maintaining a predetermined flow quality value at the outlet.

3. The system of claim 1, wherein the refrigerant flow control device controls the flow of refrigerant simultaneously to the inlet of the heat reclaim unit and the condenser for maintaining a predetermined flow quality value at the outlet of the heat reclaim unit.

4. The system of claim 1, wherein the refrigerant flow control device receives at the refrigerant flow control device the flow of refrigerant from a refrigerant compressor, outputs from a first output port a first proportion of the flow of refrigerant to the heat reclaim unit, and outputs from a second output port a second proportion of the flow of refrigerant to the condenser.

5. The system of claim 1, wherein the inlet of the heat reclaim unit receives the first flow of refrigerant having a vapor state; and outputs at the outlet of the heat reclaim unit the second flow of refrigerant having a liquid state.

6. The system of claim 1, further comprising coupling a bypass device between the inlet and the outlet that outputs a proportion of refrigerant to the condenser in response to a high refrigerant temperature or high refrigerant pressure.

7. A method for controlling a flow of refrigerant at a refrigeration system, comprising:

receiving, by a controller from a first sensor, a first measurement of temperature and pressure of a first flow of refrigerant at an inlet of a heat reclaim unit;

receiving, by a controller from a second sensor, a second measurement of temperature and pressure of a second flow of refrigerant at an outlet of the heat reclaim unit;

comparing, by the controller, the first measurement and the second measurement to a reference pressure-temperature setpoint; and modulating, by the controller, a refrigerant flow control device coupled to a condenser and the heat reclaim unit in response to the comparison, the refrigerant flow control device outputting proportions of refrigerant to the condenser and the heat reclaim unit, respectively, until updated measurements equal the reference pressure-temperature setpoint.

8. The method of claim 7, wherein modulating the refrigerant flow control device comprises controlling the first flow of the refrigerant to at least one of the inlet of the heat reclaim unit and the condenser for maintaining a predetermined flow quality value at the outlet of the heat reclaim unit.

9. The method of claim 8, wherein the condenser is an air-cooled condenser.

10. The method of claim 7, wherein modulating the refrigerant flow control device comprises:

receiving at the refrigerant flow control device the first flow of refrigerant from a refrigerant compressor;

outputting from a first output port a first proportion of the first flow of refrigerant to the heat reclaim unit; and outputting from a second output port a second proportion of the first flow of refrigerant to an air cooled condenser.

11. The method of claim 7, further comprising monitoring refrigerant pressure and temperature at each of the inlet and the outlet for controlling refrigerant flows.

12. The method of claim 7, further comprising:

receiving at a refrigerant inlet of a heat exchanger a flow of refrigerant having a first state; and outputting at a refrigerant outlet of the heat exchanger the flow of refrigerant having a second state.

13. The method of claim 7, further comprising coupling a bypass device between the refrigerant inlet and the refrigerant outlet that outputs a proportion of refrigerant to an air-cooled condenser in response to a high refrigerant temperature or a high refrigerant pressure, wherein the method further comprises controlling the bypass device to bypass the refrigerant flow control device with respect to the proportion of the flow of refrigerant and to output the proportion of the flow of refrigerant directly to the condenser when a determination is made that a measured pressure is greater than a predetermined refrigerant high pressure limit, or a measured fluid temperature is greater than a predetermined high temperature limit.

* * * * *